United States Patent [19]

Metrailer

[11] 4,269,696

[45] May 26, 1981

[54] FLUID COKING AND GASIFICATION PROCESS WITH THE ADDITION OF CRACKING CATALYSTS

[75] Inventor: William J. Metrailer, Baton Rouge, La.

[73] Assignee: Exxon Research & Engineering Company, Florham Park, N.J.

[21] Appl. No.: 92,471

[22] Filed: Nov. 8, 1979

[51] Int. Cl.[3] ..... C10G 11/18; C10G 9/32; C10G 51/04

[52] U.S. Cl. ..... 208/120; 201/38; 208/50; 208/53; 208/55; 208/127; 208/123

[58] Field of Search ..... 208/120, 50, 127, 51–55

[56] References Cited

U.S. PATENT DOCUMENTS

| | | | |
|---|---|---|---|
| 2,888,395 | 5/1959 | Henny | 208/111 |
| 3,278,412 | 11/1966 | Brown | 208/11 R |
| 3,475,323 | 10/1969 | Stuckey et al. | 208/97 |
| 3,537,975 | 11/1970 | Blaser | 208/50 |
| 3,726,791 | 4/1973 | Kimberlin et al. | 208/127 |
| 3,803,023 | 4/1974 | Hamner | 208/46 |

FOREIGN PATENT DOCUMENTS

| | | | |
|---|---|---|---|
| 762831 | 12/1956 | United Kingdom | 208/46 |

*Primary Examiner*—Delbert E. Gantz
*Assistant Examiner*—G. E. Schmitkons
*Attorney, Agent, or Firm*—Marthe L. Gibbons

[57] ABSTRACT

An integrated fluid coking and gasification process is provided in which a solid cracking catalyst is added to the coker chargestock and in which a partially gasified coke matrix comprising the cracking catalyst is recycled to the coker vapor phase product.

15 Claims, 2 Drawing Figures

FLUID COKING AND GASIFICATION PROCESS WITH THE ADDITION OF CRACKING CATALYSTS

BACKGROUND OF THE INVENTION

1. Field of the Invention

This invention relates to an improvement in an integrated fluid coking and gasification process in which cracking catalyst particles are added to the fluid coker.

2. Description of the Prior Art

Integrated fluid coking and gasification processes are known. See, for example, U.S. Pat. Nos. 3,661,543; 3,702,516 and 3,759,676, the teachings of which are hereby incorporated by reference.

A coking process is known in which coking is conducted in the presence of added hydrogen and a solid particulate contact material which may be bauxite, silica, or silica-alumina and which may further contain a hydrogenation component. See U.S. Pat. No. 2,888,395.

It is known to coke a heavy carbonaceous material in the presence of an alkali metal compound. The resulting coke, after partial gasification, is recycled to the coking zone. See U.S. Pat. No. 3,803,023.

A fluid coking process is known in which tar sand oil is coked. Fines from the cyclone to the low temperature burner with some of the coarser solids from the burner are regenerated in a fluid bed and used as cracking catalyst in the coking reactor. See U.S. Pat. No. 3,278,412.

An integrated coking and steam gasification process is known in which the coker feedstock is treated in the coker in the presence of a supported Group VB, VIIB or VIII metal oxide steam gasification catalyst. See U.S. Pat. No. 3,726,791.

It is known to scrub flue gas containing cracking catalyst with a heavy hydrocarbon oil which is subsequently used as feed for a fluid coker. See British Pat. No. 762,831.

It has now been found that the addition of a cracking catalyst to the coker feedstock and recycling the partially gasified catalyst-containing coke to the vapor phase product of the coking zone will provide advantages that will become apparent in the ensuing description.

SUMMARY OF THE INVENTION

In accordance with the invention there is provided, in an integrated coking and gasification process comprising the steps of:

(a) reacting a carbonaceous chargestock in a coking zone containing a bed of fluidized solids maintained at fluid coking conditions, including a total pressure of from about 0 to 150 psig, in the absence of added hydrogen, to produce a vapor phase product, including normally liquid hydrocarbons, and coke, said coke depositing on said fluidized solids;

(b) introducing a portion of said solids with the coke deposit thereon into a heating zone operated at a temperature greater than said coking zone temperature to heat said portion of solids;

(c) recycling a first portion of heated solids from said heating zone to said coking zone;

(d) introducing a second portion of said heated solids to a fluid bed gasification zone maintained at a temperature greater than said heating zone;

(e) reacting said second portion of heated solids in said gasification zone with steam and an oxygen-containing gas to produce a partially gasified coke and a gaseous stream comprising hydrogen, the improvement which comprises adding to said carbonaceous chargestock solid cracking catalyst particles having a particle size of less than about 44 microns in diameter and recycling at least a portion of said partially gasified coke of step (e) to contact said vapor phase product, said partially gasified coke comprising said cracking catalyst, said partially gasified coke serving as matrix wherein said cracking catalyst particles are dispersed.

DESCRIPTION OF THE PREFERRED EMBODIMENTS

Figure 1:
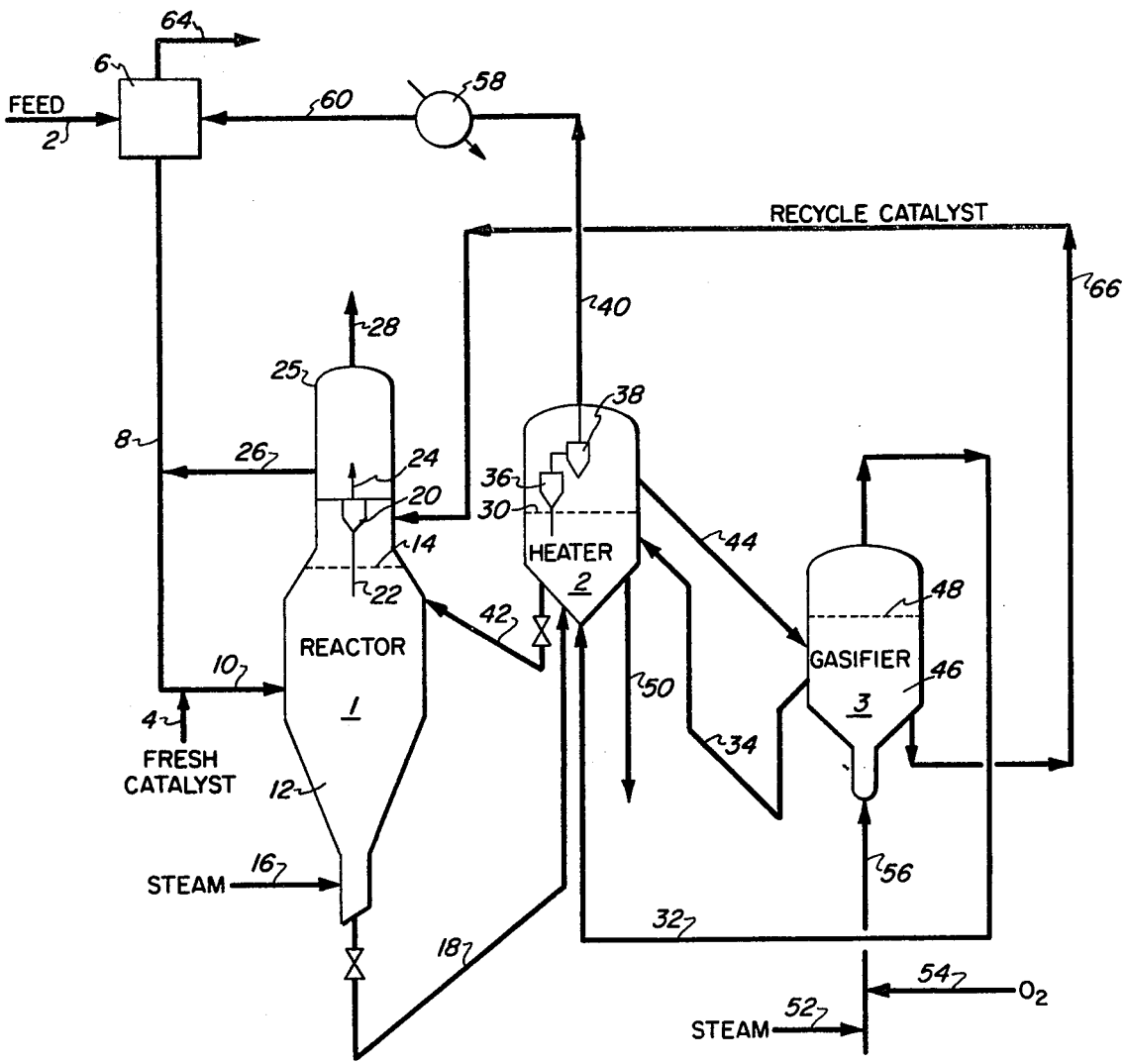
FIG. 1 is a schematic flow plan of one embodiment of the invention.

Referring to FIG. 1, a carbonaceous material having a Conradson carbon residue of about 15 weight percent, such as heavy residuum having a boiling point (at atmospheric pressure) of about 1050° F.+ is passed by line 2 into a scrubbing zone 6. Suitable carbonaceous material which will be used as feeds for the fluid coking stage of the present invention include heavy hydrocarbonaceous oils; heavy and reduced petroleum crudes; petroleum atmospheric distillation bottoms; petroleum vacuum distillation bottoms; pitch, asphalt, bitumen; other heavy hydrocarbon residues; liquid products derived from coal liquefaction processes, including coal liquefaction bottoms; coal; coal slurries, and mixtures thereof. Typically such feeds have a Conradson carbon residue of at least 5 weight percent, generally from about 5 to about 50 weight percent, preferably above about 7 weight percent (as to Conradson carbon residue, see ASTM Test D 189-65). In scrubbing zone 6, the carbonaceous feed contacts a gaseous effluent comprising catalytic fines, the derivation of which will be later described. At least a portion of the catalytic fines of the gaseous effluent are separated from the effluent and entrained into the carbonaceous feed. The resulting carbonaceous feed comprising catalytic fines is removed from scrubbing zone 6 by line 8. A cracking catalyst is added to the carbonaceous feed in line 8 by line 4. Suitable cracking catalysts include conventional composite catalysts or catalytic components known to have catalytic hydrocarbon cracking activity, for example, catalytic clays, acid-treated clays, synthetic or naturally occuring crystalline aluminosilicate zeolite, which may further have been exchanged with hydrogen ions, hydrogen precursor ions, rare earth metals, calcium, magnesium, zinc, etc; inorganic oxides such as silica, silica-alumina, silica-magnesia, silica-zirconia, silica-boria and mixtures thereof; oxides of metals of Groups IVB, VIB of the Periodic Table of Elements and mixtures thereof, such as titanium oxide, zirconium oxide, chromium oxide, molybdenum oxide, tungsten oxide. The metal oxides may be supported or unsupported. Preferably, the cracking catalyst is a supported inorganic metal oxide of a Group VIB metal such as tungsten oxide on a support such as alumina. The Periodic Table referred to herein is in accordance with the table published by Sargent-Welch, copyright 1968. When coal is used as feed, the coal particles may be slurried in the liquid medium to which the cracking catalyst is added. The fresh cracking catalyst is added to the carbonaceous feed in an amount such that the total catalyst (fresh catalyst plus recycled catalyst) ranges from about 0.1 to about 10 weight percent, preferably from about 1 to about 10 weight percent, based on the initial coker feed. The fresh catalyst will generally be added in an amount ranging from about 0.1 to about 3 weight percent. The particles of the added catalyst are below about 44 microns in diameter, preferably not greater than about 20 microns in diameter, more preferably less than 5 microns in diameter. The carbonaceous feed comprising fresh catalyst and catalyst fines is introduced by line 10 into coking zone 12 in which is maintained a fluidized bed of solids (e.g. coke particles of 40 to 1000 microns in size) having an upper level indicated at 14. Above the fluidized bed of solids, is a dilute phase. The fluidizing gas, e.g. steam, is admitted at the base of coking reactor 1 through line 16 in an amount sufficient to obtain a superficial fluidizing gas velocity in the range of 0.3 to 5 feet per second. The coking reaction is conducted in the absence of added hydrogen. Solids at a temperature above the coking temperature, for example, at a temperature of from about 100 to 800 Fahrenheit degrees in excess of the actual operating temperature of the coking zone is admitted to reactor 1 by line 42 in an amount sufficient to maintain the coking temperature in the range of about 850 to about 1200° F., preferably at a temperature ranging from about 900° to about 1200° F. The pressure in the coking zone is maintained in the range of about 0 to about 150 pounds per square inch gauge (psig), preferably in the range of about 40 to about 45 psig. The lower portion of the coking reactor serves as a stripping zone to remove occluded hydrocarbons from the coke. A stream of solids is withdrawn from the stripping zone by line 18 and circulated to heater 2. Conversion products are passed through cyclone 20 to remove entrained solids which are returned to the coking zone through dipleg 22. The vapors leave the cyclone through line 24 and pass into scrubber 25 mounted on the coking reactor. If desired, a stream of heavy material condensed in the scrubber may be recycled to the coking reactor via line 26. The coker conversion products are removed from scrubber 25 via line 28 for fractionation in a conventional manner. In heater 2, stripped solids from coking reactor 1 (cold solids) are introduced by line 18 to a fluid bed of hot solids having an upper level indicated at 30. The bed is partially heated by passing a flue gas into the heater by line 32. Supplementary heat is supplied to the heater by the solids circulating in line 34. The heating zone is operated at a temperature ranging from about 100 to 800 Fahrenheit degrees greater than the coking zone temperature. The gaseous effluent of the heater, including entrained solids, passes through a cyclone which may be a first cyclone 36 and a second cyclone 38 wherein separation of the larger entrained solids occurs. The separated larger solids are returned to the heater bed via the respective cyclone diplegs. The heater gaseous effluent which still contains entrained solid fines is removed from heater 2 via line 40. The heater gaseous effluent is passed by line 40 through indirect heat exchanger 58. The partially cooled gas, containing entrained solids which include cracking catalyst, is passed via line 60 into scrubbing zone 6 in which the gaseous effluent contacts the carbonaceous coker feed. At least a portion of the catalytic solids that is present in the gas is separated from the gas and passes into the carbonaceous feed. The gaseous effluent from which at least a portion of the catalytic solids (fines) has been separated is removed from scrubbing zone 6 via line 64.

Hot solids comprising coke are removed from the fluidized bed in heater 2 and recycled to coking reactor by line 42 to supply heat thereto. Another portion of solids is removed from heater 2 and passed by line 44 to a gasification zone 46 in gasifier 3 in which is maintained a bed of fluidized solids comprising coke having a level indicated at 48. If desired, a purge stream of solids may be removed from heater 2 by line 50.

The gasification zone is maintained at a temperature ranging from about 1000° to 2800° F., preferably from about 1400° to about 2000° F., and a pressure ranging from about 0 to about 150 psig, preferably at a pressure ranging from about 0 to 60 psig and more preferably at a pressure ranging from about 25 to about 45 psig. Steam by line 52 and an oxygen-containing gas such as air, commercial oxygen or air mixed with oxygen by line 54 are passed via line 56 into gasifier 3. Reaction of the solid particles comprising coke in the gasification zone with steam and the oxygen-containing gas produces a hydrogen and carbon monoxide-containing fuel gas and a partially gasified coke product which comprises the cracking catalyst that was introduced into the coker. The partially gasified coke serves as a coke matrix in which the catalyst particles are dispersed. At least a portion of the resulting solid product comprising cracking catalyst dispersed in a coke matrix is removed from the gasifier by line 66 and introduced into the coker vapor phase product, that is, it is introduced into the dilute phase above fluid bed 14 to contact initially the vapor phase product from the dense phase. The gasifier product fuel gas, which may contain some entrained solids, including catalyst fines, is removed overhead from gasifier 3 by line 32 and introduced into heater 2 to provide a portion of the required heat as previously described.

Figure 2:
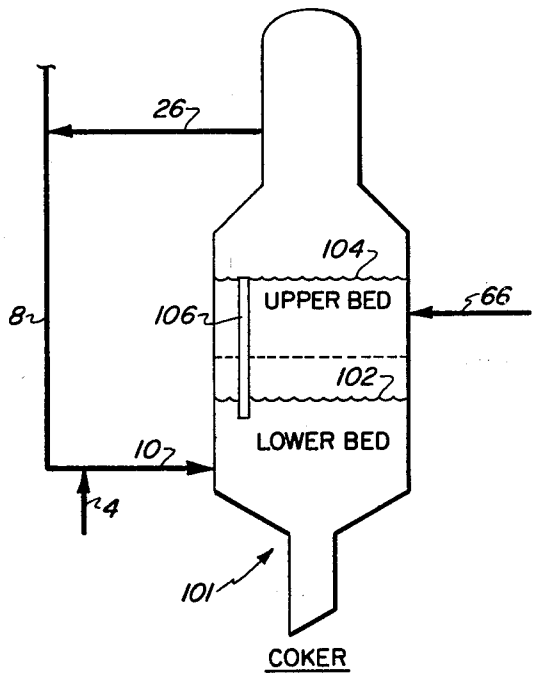
FIG. 2 is a schematic flow plan of another embodiment of the invention.

The FIG. 2 embodiment differs from the FIG. 1 embodiment in that instead of coking reactor 1, coking reactor 101 is utilized. Coker 101 comprises a lower fluidized bed having a level 102 into which the carbonaceous feed comprising the fresh catalyst and catalyst fines is introduced via line 10. The vapor phase product of the lower bed flows from the lower bed into an upper bed of fluidized solids having an upper level indicated at 104. Heat for the upper bed is supplied by circulating the stream of partially gasified coke matrix comprising the cracking catalyst dispersed therein via line 66 directly from the gasifier to the upper bed. In this embodiment, therefore, the partially gasified coke matrix in which the cracking catalyst particles are dispersed also contacts the vapor phase coke product to produce further cracking as well as to provide heat. Solids flow from the upper bed via tube 106 into the lower bed.

What is claimed is:

1. In an integrated coking and gasification process comprising the steps of:

(a) reacting a carbonaceous chargestock in a coking zone containing a bed of fluidized solids maintained at fluid coking conditions, including a total pressure of about 0 to 150 psig, in the absence of added hydrogen, to produce a vapor phase product including normally liquid hydrocarbons, and coke, said coke depositing on said fluidized solids;

(b) introducing a portion of said solids with the coke deposit thereon into a heating zone operated at a temperature greater than said coking zone temperature to heat said portion of said solids;

(c) recycling a first portion of heated solids from said heating zone to said coking zone;

(d) introducing a second portion of said heated solids to a fluid bed gasification zone maintained at a temperature greater than said heating zone, and (e) reacting said second portion of heated solids in said gasification zone with steam and an oxygen-containing gas to produce a partially gasified coke and a gaseous stream comprising hydrogen, the improvement which comprises adding to said carbonaceous chargestock solid cracking catalyst particles having a particle size of less than about 44 microns in diameter and recycling at least a portion of said partially gasified coke of step (e) to contact the vapor phase product above said bed of fluidized solids of said coking zone, said partially gasified coke comprising said cracking catalyst, said partially gasified coke serving as matrix wherein said cracking catalyst particles are dispersed.

2. The process of claim 1 wherein said catalyst is added to said chargestock in an amount ranging from about 0.1 to about 10 weight percent based on said chargestock.

3. The process of claim 1 wherein said catalyst has a particle size of less than about 20 microns in diameter.

4. The process of claim 1 wherein said catalyst is selected from the group consisting of clay cracking catalyst, crystalline aluminosilicate zeolites, inorganic oxides and mixtures thereof.

5. The process of claim 1 wherein said catalyst comprises an inorganic oxide selected from the group consisting of silica, silica-alumina, silica-magnesia, silica-boria, silica-zirconia and mixtures thereof.

6. The process of claim 1 wherein said catalyst comprises a metal oxide selected from the group consisting of oxides of Group IVB and VIB metals of the Periodic Table of Elements and mixtures thereof.

7. The process of claim 1 wherein said cracking catalyst comprises a metal oxide selected from the group consisting of tungsten oxide, titanium oxide, zirconium oxide, chromium oxide, and mixtures thereof.

8. The process of claim 7 wherein said catalyst comprises a support.

9. The process of claim 1 wherein said catalyst comprises tungsten oxide.

10. The process of claim 9 wherein said catalyst comprises an alumina support.

11. The process of claim 1 wherein the effluent of said heating zone comprises entrained catalyst fines and wherein at least a portion of said catalyst fines is recovered and recycled to said carbonaceous chargestock.

12. The process of claim 1 wherein said fluid coking zone is operated at a temperature ranging from about 850° to about 1200° F. wherein said gasification zone is operated at a temperature ranging from about 1400° to about 2000° F.

13. The process of claim 1 wherein said gasification zone is operated at a pressure ranging from about 0 to about 150 psig.

14. The process of claim 1 wherein said partially gasified coke of step (e) is recycled to a dilute phase above said fluidized bed of solids of said coking zone.

15. The process of claim 1 wherein another bed of fluidized solids is positioned at a spaced distance above said bed of fluidized solids of step (a), whereby said vapor phase product flows into the upper fluidized bed and wherein said partially gasified coke of step (e) contacts said vapor phase product in said upper fluidized bed.

* * * * *